US012655781B1

(12) United States Patent
Mital et al.

(10) Patent No.: US 12,655,781 B1
(45) Date of Patent: Jun. 16, 2026

(54) ENGINE EXHAUST AFTERTREATMENT SYSTEM ARCHITECTURE WITH COORDINATED EMISSION CONTROL

(71) Applicant: GM GLOBAL TECHNOLOGY OPERATIONS LLC, Detroit, MI (US)

(72) Inventors: Rahul Mital, Rochester Hills, MI (US); Layne Lavern Wagner, Clarkston, MI (US); Usman Asad, LaSalle (CA)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 19/061,378

(22) Filed: Feb. 24, 2025

(51) Int. Cl.
*F01N 3/20* (2006.01)
*F01N 3/10* (2006.01)

(52) U.S. Cl.
CPC ..... *F01N 3/2013* (2013.01); *F01N 3/106* (2013.01); *F01N 3/208* (2013.01)

(58) Field of Classification Search
CPC ..... F01N 3/0842; F01N 3/035; F01N 3/2066; F01N 2370/02; F01N 2250/12
See application file for complete search history.

(56) References Cited

U.S. PATENT DOCUMENTS

| | | | | |
|---|---|---|---|---|
| 7,763,222 | B2 * | 7/2010 | Miyairi | F01N 13/009 422/177 |
| 7,818,960 | B2 | 10/2010 | Gonze et al. | |
| 8,813,478 | B2 | 8/2014 | Gonze et al. | |
| 8,931,265 | B2 | 1/2015 | Ramamurthy | |
| 9,657,626 | B2 * | 5/2017 | Theis | B01D 53/9477 |
| 9,784,161 | B2 * | 10/2017 | Brück | F01N 3/0335 |
| 9,909,482 | B2 | 3/2018 | Ardanese et al. | |
| 10,337,377 | B2 | 7/2019 | Latrofa et al. | |
| 10,480,369 | B1 * | 11/2019 | Dahodwala | F01N 3/106 |
| 11,359,529 | B2 * | 6/2022 | Sculto | F01N 3/2066 |
| 11,898,483 | B2 | 2/2024 | Lue et al. | |
| 2011/0162358 | A1 * | 7/2011 | Bruck | F01N 3/2885 60/605.1 |
| 2013/0294990 | A1 * | 11/2013 | Koch | B01D 53/9477 423/213.2 |

(Continued)

FOREIGN PATENT DOCUMENTS

| | | | | |
|---|---|---|---|---|
| DE | 102015115104 | A1 | 3/2016 | |
| FR | 3029970 | A1 * | 6/2016 | F01N 3/103 |

OTHER PUBLICATIONS

FR-3029970-A1 English Translation (Year: 2016).*

*Primary Examiner* — Anthony Ayala Delgado
(74) *Attorney, Agent, or Firm* — Ingrassia Fisher & Lorenz, LLP | IF&L

(57) ABSTRACT

An exhaust system architecture provides a coordinated control approach that considers aspects of the involved aftertreatment components. An aftertreatment system under this architecture includes a conduit system that conveys an exhaust gas stream from the engine to atmosphere. A diesel oxidation catalyst unit is disposed in the conduit system. A selective catalyst reduction unit is disposed in the conduit system downstream from the DOC unit. A passive NOx absorber unit is disposed in the conduit system downstream from the DOC unit at a location that is disposed at a distance from the engine. The distance is effective to, following a cold start of the engine, enable the SCR unit to heat to a conversion threshold temperature before the PNA unit heats to a release threshold temperature.

20 Claims, 6 Drawing Sheets

(56) References Cited

U.S. PATENT DOCUMENTS

| | | | | |
|---|---|---|---|---|
| 2014/0311123 | A1 | 10/2014 | Gonze et al. | |
| 2015/0252706 | A1* | 9/2015 | Kosters | F01N 3/2066 60/297 |
| 2016/0341091 | A1* | 11/2016 | Theis | B01D 53/9477 |
| 2021/0277815 | A1 | 9/2021 | Henrichsen et al. | |
| 2022/0275747 | A1* | 9/2022 | Luo | F01N 11/00 |

* cited by examiner

ENGINE EXHAUST AFTERTREATMENT SYSTEM ARCHITECTURE WITH COORDINATED EMISSION CONTROL

INTRODUCTION

The technical field generally relates to internal combustion engine exhaust systems, and more particularly relates to an aftertreatment system architecture for exhaust systems with optimized and coordinated component performance results including during cold starts of the engine.

An operating internal combustion engine draws an air/fuel mixture into its cylinders. The air/fuel mixture is compressed and following ignition is combusted to provide power to drive the engine cylinders to expand via movement of pistons. Power generated by the piston movements is used to drive aspects of various types of machines both mobile and stationary. After the power stroke, the pistons move the resulting gases out through an exhaust system. In the case of a diesel engine, untreated exhaust gases may contain components that result from combustion such as water ($H_2O$), particulate matter (PM), carbon monoxide (CO), hydrocarbons (HC), nitrogen oxides (NOx) and others.

Exhaust systems may include components that provide aftertreatment processes to convert (such as through reduction and oxidation) or capture certain constituents of the resulting gases. For example, a diesel oxidation catalyst (DOC) may be employed to convert emissions of the organic PM, HC, CO and NO. A diesel particulate filter (DPF) may be employed to capture PM. The DPF may be regenerated for cleaning. A selective catalytic reduction device (SCR) may be employed to convert NOx to nitrogen ($N_2$) and $H_2O$. A reductant may be injected into the exhaust system upstream of the SCR to enhance the reduction of NOx to nitrogen and water in the presence of the SCR catalyst. Optimizing the reduction of target constituents in the exhaust gases over a wide range of environmental and operating conditions remains a goal.

Accordingly, there is a desire to provide exhaust systems designed and constructed to have optimal aftertreatment process performance, while doing so in a flexible manner that is tailorable to various applications. There is also a desire to provide effective performance over a variety of conditions. Furthermore, other desirable features and characteristics of the present disclosure will become apparent from the subsequent detailed description and the appended claims, taken in conjunction with the accompanying drawings and the foregoing introduction.

SUMMARY

An exhaust system architecture provides a coordinated control approach that considers aspects of the involved aftertreatment components. In a number of embodiments, an exhaust system architecture provides a coordinated control approach that considers aspects of the involved aftertreatment components. An aftertreatment system under this architecture includes a conduit system that conveys an exhaust gas stream from the engine to atmosphere. A diesel oxidation catalyst unit is disposed in the conduit system. A selective catalyst reduction unit is disposed in the conduit system downstream from the DOC unit. A passive NOx absorber unit is disposed in the conduit system downstream from the DOC unit at a location that is disposed at a distance from the engine. The distance is effective to, following a cold start of the engine, enable the SCR unit to heat to a conversion threshold temperature before the PNA unit heats to a release threshold temperature.

In additional embodiments, the PNA unit is located in the conduit system upstream in the exhaust gas stream from the SCR unit.

In additional embodiments, a heater is disposed in the conduit system upstream in the exhaust gas stream from the SCR unit.

In additional embodiments, the DOC unit and the PNA unit are disposed in one container with the PNA unit separate from the DOC unit.

In additional embodiments, the PNA unit is located in the conduit system upstream in the exhaust gas stream from the SCR unit, and a second SCR unit is located upstream in the exhaust gas stream from the PNA unit.

In additional embodiments, the engine is disposed in an engine compartment of a vehicle, and the DOC unit, the PNA unit and the SCR unit are all disposed in the engine compartment.

In additional embodiments, the conduit system includes a pipe section channeling the exhaust gas stream and separating the DOC unit from the PNA unit by the distance.

In additional embodiments, at least one controller operates to: monitor, through signals from a sensor array, parameters of the aftertreatment system; determine, by at least one processor, whether the PNA unit is approaching the release threshold temperature; and control, by the at least one processor, the engine to adjust heat output from the engine.

In additional embodiments, at least one controller operates to: monitor, through signals from a sensor array, parameters of the aftertreatment system; determine, by at least one processor and based on the signals, whether the PNA unit is approaching the release threshold temperature; determine, by the at least one processor and based on the signals, whether the SCR unit is approaching the conversion threshold temperature; and control, by the at least one processor, the engine to adjust heat output from the engine.

In additional embodiments, at least one controller operates to: monitor, through signals from a sensor array, parameters of the aftertreatment system; determine, by at least one processor and based on the signals, whether the PNA unit is approaching the release threshold temperature; determine, by the at least one processor and based on the signals, whether the SCR unit is approaching the conversion threshold temperature; and control, by the at least one processor, the engine to adjust heat output from the engine and the heater so that the SCR unit reaches the conversion threshold temperature before the PNA unit reaches the release threshold temperature.

In a number of other embodiments, an aftertreatment system for an engine includes a conduit system to convey an exhaust gas stream generated by the engine from the engine to atmosphere. A DOC unit is disposed in the conduit system to convert HC. An SCR unit is disposed in the conduit system downstream in the exhaust gas stream from the DOC unit to convert NOx. A PNA unit is disposed in the conduit system to store NOx and is located downstream in the exhaust gas stream from the DOC unit at a location that is disposed at a distance from the engine. The distance, following a cold start of the engine, enables the SCR unit to heat to a conversion threshold temperature before the PNA unit heats to a release threshold temperature.

In additional embodiments, the PNA unit is located in the conduit system upstream in the exhaust gas stream from the SCR unit so that when the PNA unit reaches the release threshold temperature, a release of the NOx into the exhaust gas stream is directed through the SCR unit.

In additional embodiments, a heater is disposed in the conduit system upstream in the exhaust gas stream from the SCR unit and is located downstream in the exhaust gas stream from the PNA unit.

In additional embodiments, the DOC unit and the PNA unit are disposed in one container with the PNA unit in a first space that is separate from a second space containing the DOC unit. The PNA unit and the DOC unit are defined on a common substrate.

In additional embodiments, the PNA unit is located in the conduit system upstream in the exhaust gas stream from the SCR unit. A second SCR unit is located upstream in the exhaust gas stream from the PNA unit. A heater is located downstream in the exhaust gas stream from the PNA unit.

In additional embodiments, the engine is disposed in an engine compartment of a vehicle. The DOC unit, the PNA unit and the SCR unit are all disposed in the engine compartment. A second SCR unit is located under the vehicle's floor pan and outside the engine compartment.

In additional embodiments, the conduit system includes a pipe section channeling the exhaust gas stream and separating the DOC unit from the PNA unit by the distance. The distance reduces a temperature of the exhaust gas stream between the DOC unit and the PNA unit by a target magnitude.

In additional embodiments, at least one controller operates to: monitor, through signals from a sensor array, parameters of the aftertreatment system, wherein the sensor array includes temperature sensors in the conduit system; determine, by at least one processor, whether the PNA unit is approaching the release threshold temperature at which the PNA unit releases NOx; and control, by the at least one processor, the engine to adjust heat output from the engine to slow the heating of the PNA unit.

In additional embodiments, at least one controller operates to: monitor, through signals from a sensor array, parameters, including temperatures, of the aftertreatment system; determine, by at least one processor and based on the signals, whether the PNA unit is approaching the release threshold temperature at which the PNA unit releases NOx; determine, by the at least one processor and based on the signals, whether the SCR unit is approaching the conversion threshold temperature at which the SCR unit converts NOx at a threshold rate; and control, by the at least one processor, the engine to adjust heat output from the engine so that the SCR unit reaches the conversion threshold temperature before the PNA unit reaches the release threshold temperature.

In a number of additional embodiments, an aftertreatment system for an engine includes a conduit system to convey an exhaust gas stream generated by the engine from an exhaust manifold of the engine to atmosphere. A DOC unit is disposed in the conduit system to convert HC. An SCR unit is disposed in the conduit system downstream in the exhaust gas stream from the DOC unit to convert NOx. A PNA unit is disposed in the conduit system to store NOx in a first temperature range and to release the NOx in a second temperature range. The PNA unit is located downstream in the exhaust gas stream from the DOC unit at a location that is disposed at a distance from the exhaust manifold of engine. The distance, following a cold start of the engine, enables the SCR unit to heat to a conversion threshold temperature before the PNA unit heats to a release threshold temperature. An electric heater is disposed in the conduit system disposed upstream in the exhaust gas stream from the SCR unit and is located downstream in the exhaust gas stream from the PNA unit. At least one controller operates to: monitor, through signals from a sensor array, parameters, including temperatures, of the aftertreatment system; determine, by at least one processor and based on the signals, whether the PNA unit is approaching the release threshold temperature; determine, by the at least one processor and based on the signals, whether the SCR unit is approaching the conversion threshold temperature; and control, by the at least one processor, the engine to adjust heat output from the engine and the electric heater so that the SCR unit reaches the conversion threshold temperature before the PNA unit reaches the release threshold temperature.

BRIEF DESCRIPTION OF THE DRAWINGS

The exemplary embodiments will hereinafter be described in conjunction with the following drawing figures, wherein like numerals denote like elements, and wherein.

DETAILED DESCRIPTION

The following detailed description is merely exemplary in nature and is not intended to limit the application and uses. Furthermore, there is no intention to be bound by any expressed or implied theory presented in the preceding introduction or the following detailed description.

Figure 1:
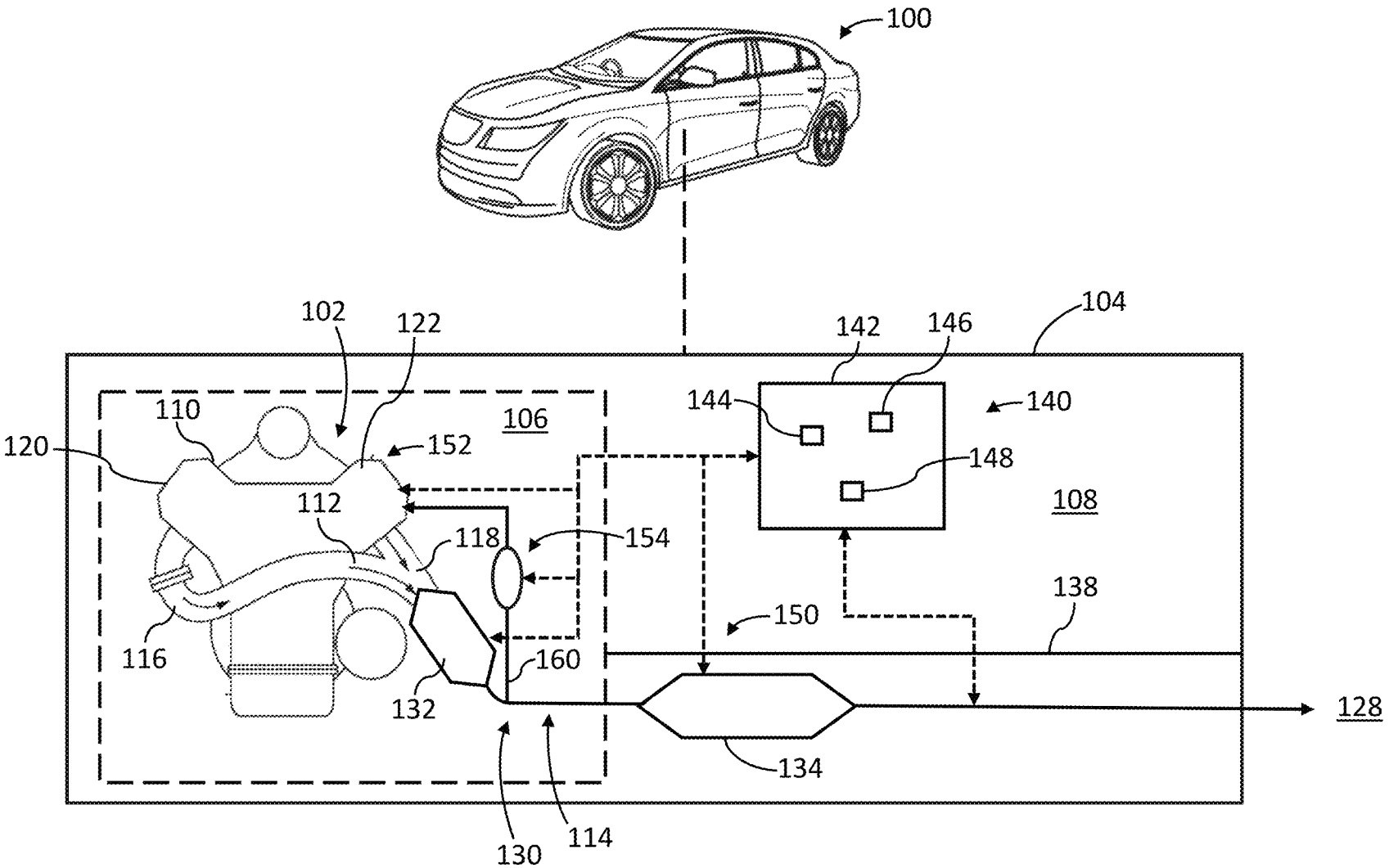
FIG. 1 is a schematic illustration of a powered system in the form of a vehicle with an engine and exhaust system that includes an aftertreatment system, in accordance with various embodiments.

Referring to FIG. 1, illustrated is a powered system in the form of a vehicle 100, according to an exemplary embodiment. In other embodiments, the powered system may be another type of vehicle or a different type of machinery, and may be operable as a mobile unit, as a stationary unit, or as both. In general, the vehicle 100 includes a powertrain 102 that operates to propel the vehicle 100. In some embodiments, the vehicle 100 comprises an automobile. In various embodiments, the vehicle 100 may be any one of a number of different types of automobiles, such as, for example, a sedan, a wagon, a truck, or a sport utility vehicle (SUV), and may be two-wheel drive (2WD) (i.e., rear-wheel drive or front-wheel drive), four-wheel drive (4WD) or all-wheel drive (AWD), and/or various other types of vehicles in certain embodiments. In certain embodiments, the vehicle 100 may also comprise one or more other types of vehicles. In addition, in various embodiments, it will be appreciated that the vehicle 100 may comprise any number of other types of mobile platforms. In the depicted embodiment, the body 104 of the vehicle 100 substantially encloses other components of the vehicle 100 and defines an engine compartment 106 and a cabin 108 that is configured to carry occupants.

In various embodiments, the powertrain 102 propels the vehicle 100. The powertrain 102 preferably comprises a propulsion system. In certain exemplary embodiments, the powertrain comprises an internal combustion engine and may also include another type of powerplant such as an electric motor/generator in a hybrid or other arrangement. The powertrain 102 also includes a transmission to effect various driveline gear ratios. By way of example, the vehicle 100 includes a diesel engine 110 and in other embodiments may incorporate any one of, or combination of, a number of different types of powertrains 102, such as, for example, a gasoline or diesel fueled combustion engine, a "flex fuel vehicle" (FFV) engine (i.e., using a mixture of gasoline and alcohol), a gaseous compound (e.g., hydrogen and/or natural gas) fueled engine, a combustion/electric motor hybrid engine, and an electric motor.

For purposes of the current embodiment, the powertrain 102 is configured as a diesel engine 110. As such the engine 110 combusts a fuel and air mixture and expels an exhaust gas stream 112. The exhaust gas stream 112 is directed through an exhaust system 114 that may include any number of branches, exhaust pipe sections and various components. In the current embodiment, the conduit system includes two conduits referred to as pipes 116 and 118 connected to the exhaust manifolds 120 and 122 of the V-type engine 110 that join together forming one exhaust pipe assembly 130 as a conduit that leads to the atmosphere 128. In other embodiments, another conduit arrangement, such as one including plural exhaust pipe assemblies, may be employed.

The exhaust pipe assembly 130 of the exhaust system 114 includes a number of pipe sections and a number of elements that serve various functions. The exhaust pipe assembly 130 may include, or be connected with, additional elements such as a turbocharger, a muffler, and other monitoring and aftertreatment components, none of which are shown. The exhaust pipe assembly 130 is shown generally including aftertreatment components 132 and 134 that may be disposed at various locations. For example, the aftertreatment components 132 may be disposed in the engine compartment 106 of the vehicle 100 or outside the engine compartment 106. These components may be referred to as close-coupled or underfloor. Close-coupled generally means close to the engine 110 such as in the engine compartment 136 as indicated by aftertreatment components 132. Underfloor generally means further from the engine 110, such as under the floor pan 138 of the vehicle 100 as indicated by aftertreatment components 134. Some aftertreatment components may be desirably close-coupled for operational effectiveness. Some aftertreatment components may be underfloor for other considerations, such as packaging space and routing requirements.

In embodiments, the close-coupled aftertreatment components 132 may include, among other components, either or both of a close-coupled DOC and SCR. The underfloor aftertreatment components 134 may include, among other components. any or all of SCR, ammonia dosing, heaters and PNA. In some embodiments, PNA may be included in the close-coupled aftertreatment components 132. It should be understood that while the current embodiment includes both close-coupled aftertreatment components 132 and underfloor aftertreatment components 134, certain embodiments include only one of the two. For example, only the close-coupled aftertreatment components 132 may be included or only the underfloor aftertreatment components 134 may be included. Which arrangement is used depends on the engine 110 involved, the application within which the engine 110 is used, the packaging space available, the aftertreatment targets, and other factors. Inclusion of SCR in the close-coupled aftertreatment components 132 may be desirable for various purposes, including for effectiveness during various certain emission cycles. For example, a close-coupled SCR may be effective in lower temperature/low flow rate cycles. In other embodiments, an underfloor SCR may be desirable for various purposes including for high temperature conditions and/or high flow rate conditions where a close coupled SCR's effectiveness is limited or has passed its peak operational efficiency.

The vehicle 100 also includes a control system 140 that includes a controller 142, which comprises a computer system. The controller 142 may be one or more controllers working cooperatively. The computer system of the controller 142 includes a processor 144, a memory 146 and a storage device 148. The processor 144 performs the computation and control functions of the controller 142, and may comprise any type of processor or multiple processors, single integrated circuits such as a microprocessor, or any suitable number of integrated circuit devices and/or circuit boards working in cooperation to accomplish the functions of a processing unit. Plural processors 144 may be used in one or more controllers 142. During operation, the processor 144 executes one or more programs contained within the memory 146 and, as such, controls the general operation of the controller 142 and the computer system of the controller 142, generally in executing the monitoring and control actions described herein, such as those described further below. The memory 146 stores the above-referenced program along with stored values (e.g., including, in various embodiments, predetermined threshold values, operating set points, etc. for controlling emissions). The storage device 148 may be any suitable type of storage apparatus, including various different types of direct access storage and/or other memory devices. The storage device 148 may comprise a program product from which the memory 146 receives programs that executes one or more embodiments of one or more aspects of the present disclosure, such as the steps of the control actions described further below in connection with the illustrative embodiments.

In various embodiments, the controller 142 is coupled with the engine 110, the exhaust system 114 and a sensor array 150, which includes sensors at the engine 110 and at the exhaust system 114. It will be appreciated that at least some of the sensors in the sensor array 150 are in the exhaust system 114. The controller 142 provides instructions for controlling the engine 110 and/or the exhaust system 114, such as through actuators 154 via commands based various parameters including on sensor data. In various embodiments, the sensors of the sensor array 150 are attached to, disposed within, or otherwise disposed in proximity to the engine 110 and the exhaust system 114 such that various positions, temperatures, concentrations, pressures, speeds, and other observable parameters are measured. In certain embodiments, the sensor array 150 may also include one or more other sensors for example for operation of other systems and devices of the vehicle 100 or for sensing parameters of the atmosphere 128. For example, in certain embodiments, the other sensors 152 may include one or more sensors for detecting when the engine 110 is turned on and/or running, one or more load sensors, such as a throttle position sensor, for detecting load/torque requests of the engine 110, and other sensors as desired.

The engine 110 also includes an exhaust gas recirculation system (EGR system) 160 which ma employed for certain purposes including to reduce NOx. The EGR system 160 may be a high pressure system or a low pressure system or some variation of the two such as a hybrid/dual type. In general, the EGR system 160 recirculates exhaust gas into the intake 162 of the engine 110. When embodied as a high pressure EGR system, exhaust gas is supplied at a point upstream from a turbocharger turbine of the engine 110 and is returned at a point downstream from the turbocharger's compressor. Both points are at relatively high pressure in the exhaust side and in the intake side of the engine 110. When embodied as a low pressure EGR system, exhaust gas is supplied at a point downstream from the turbocharger's turbine and returned at a point upstream from the turbocharger's compressor. Both points are at relatively low pressure in the exhaust side and in the intake side of the engine. The low pressure EGR system may be used for various purposes including where a higher EGR NOx reduction is desired. In some embodiments, the EGR system 160 may be embodied as a low pressure system when higher EGR flow rates are desired. In embodiments, the exhaust gas routed into the EGR system 160 may be taken after the close-coupled aftertreatment components 132 including any or all of the DOC, DPF and SCR, meaning the recirculated EGR gas is clean before it re-enters the engine 110. As such, including the close-coupled aftertreatment components 132, such as the SCR may be desirable to facilitate EGR routing. Including SCR in the close-coupled aftertreatment components 132 may be desirable for other purposes, including for effectiveness during various emission cycles.

As part of findings leading to the current disclosure, it has been discovered that the PNA NOx collection function may be prematurely curtailed in some situations. This has been observed to occur in various scenarios including when controls are effected to quickly warm the DOC and/or the SCR. It has been found that these targeted controls to heat the DOC and/or the SCR may also heat the PNA to a NOx release temperature before the SCR has reached a conversion threshold temperature where NOx conversion is effective. These discoveries have led to the architecture with the embodiments of the current disclosure where HC and NOx conversions are optimized over a range of cycles, in addition to providing the additional benefits described herein. The aftertreatment architecture disclosed herein may have plural embodiments all configured with common concepts to work at high effectiveness levels, including immediately following engine start, at high heat and load states, and in other operational and environmental conditions during various driving cycles.

Figure 2:
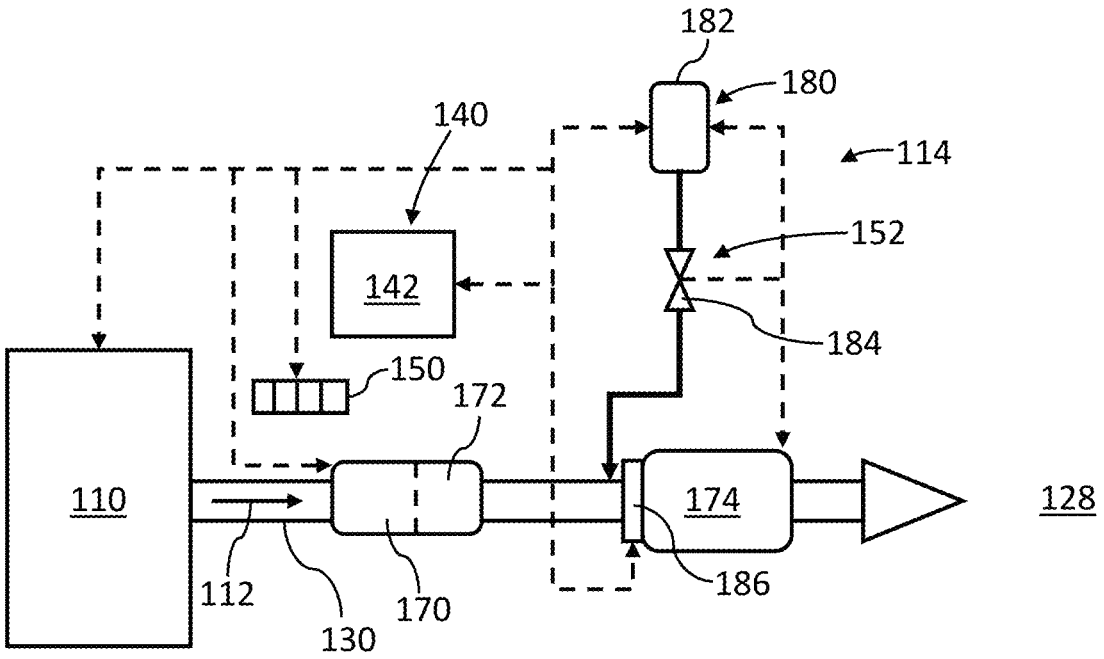
FIG. 2 is a schematic illustration of the aftertreatment system of FIG. 1 with DOC, SCR and a passive NOx absorber (PNA) downstream from DOC and upstream from SCR, in accordance with various embodiments.

Referring to FIG. 2, the exhaust system 114 is illustrated to describe the architecture in a high level schematic form. The exhaust gas stream 112 is routed from the engine 110 through the exhaust pipe assembly 130 as a conduit that leads to the atmosphere 128. The exhaust system 114 includes a DOC unit 170, a PNA unit 172 and an SCR unit 174, among other components shown and not shown. The DOC unit 170 includes materials to convert HC and CO, among other functions such as to reduce PM. The materials, which may include platinum group metal (PGM), may be coated on a substrate exposed to the exhaust gas stream 112, such as a ceramic or metal monolith substrate. The materials selected may include a base material, such as a cubic aluminum oxide with an active material or materials such as platinum or palladium, although other materials may be used or included. The PNA unit 172 may include a ceramic or metal substrate such as a microporous, crystalline aluminosilicate material coated with or otherwise carrying an adsorbant that may include palladium, platinum, silver ions, or other material that adsorbs NOx at lower temperatures and releases the stored NOx at higher temperatures. The adsorbant material may be combined with the materials used in the DOC unit 170 so that a common substrate may be used for the DOC unit 170 and the PNA unit 172 where the downstream portion (e.g., 40%-60%) of the substrate includes the PNA material and the remaining upstream portion only includes the DOC material. In other embodiments, separate substrates and/or separate containers may be used for the DOC unit 170 and the PNA unit 172. The SCR unit 174 may include a substrate coated with a catalyst in a carrier, among other materials. The catalyst may be a zeolite material, such as containing copper, iron, etc., or another material. The SCR unit 174 may comprise, or may include, an SCR on filter (SCRF) arrangement where the SCR material is coated on a DPF as the substrate. Such an SCRF, in addition to converting NOx, collects PM. In the case of any of the units 170, 172 and 174, any suitable catalyst base material or combination of catalyst base materials may be used such as those that include platinum, palladium, rhodium, vanadium, cerium, copper, iron, and others.

The exhaust system 114 includes a reductant dosing system 180, such as for injecting a material such as urea prior to the SCR unit 174 to enhance the conversion of nitrogen oxides in the SCR unit 174. The reductant dosing system 180 injects the reductant into the exhaust gas stream 112 and includes a reductant supply 182 and a metering valve 184. In the SCR unit 174, the injected reductant may convert to ammonia (NH3) which is then consumed in conversion processes.

In the current embodiment, the exhaust system 114 includes a heater 186 in the exhaust gas stream 112 before or in the SCR unit 174. The heater 186 may be an electric heater, a gas burner, or another type, supplied with power/energy for selective operation. The amount of heat generated by the heater 186 is a function of its design and of the power (volts and amps) that is supplied. The heater 186 may be used to decrease the amount of time that it takes to raise the temperature of the SCR unit 174, such as from ambient temperature to the conversion threshold temperature (SCR light-off).

In this embodiment, the exhaust gas stream 112 passes through the DOC unit 170, the PNA unit 172 and the SCR unit 174, in that order. The DOC unit 170 and the PNA unit 172 are depicted as disposed in a single container but are sequentially separated in space with the PNA unit 172 located downstream from the DOC unit 170 in the exhaust gas stream 112 and upstream from the SCR unit 174 in the exhaust gas stream 112. In other embodiments, the PNA unit 172 may be disposed in a separate container from the DOC unit 170 but still downstream therefrom. The SCR unit 174 is depicted as disposed in a separate container from the DOC unit 170 and the PNA unit 172. In other embodiments one or both of the DOC unit 170 and/or the PNA unit 172 may be disposed in a common container with the SCR unit 174. The heater 186 may be desirable for various purposes including for when there is a range gap between the range of the release threshold temperature of the PNA unit 172 and the light-off threshold temperature of the SCR unit 174.

The controller 142 is coupled with the engine 110 and the exhaust system 114 (such as at sensors, actuators, etc.) to monitor and control conditions and operations, such as through the processor 144. When starting the engine 110 from a cold condition, all components may be at, or approximately at, ambient temperature. Certain catalysts may be less effective or not effective below certain temperatures. For the DOC unit 170 and the SCR unit 174, a minimum temperature of about 200° C.-225° C. (conversion threshold temperature) for example, is needed for the catalyst to "light-off" where conversion is at a desired effectiveness. The PNA unit 172 begins adsorbing NOx at the low ambient temperatures and so is active when the engine 110 is first started. The PNA unit 172 may begin releasing (release threshold temperature) its stored NOx at approximately 200° C. and may complete its release at approximately 250° C. Due to the location of the PNA unit 172 and heat transfer/losses, the SCR unit 174 may rise in temperature slower than the DOC unit 170 and the PNA unit 172. When that is a factor, the heater 186 may be used to speed heating of the SCR unit 174. Considerations in designing the aftertreatment architecture include that reductant dosing is not desired until the SCR unit 174 reaches at least approximately 200° C. (the conversion threshold temperature).

Depending on the system architecture and the engine operating conditions, the PNA release threshold temperature may be reached at a point in time before the SCR unit 174 reaches the conversion threshold temperature. For example without the features disclosed herein, when the PNA unit 172 reaches 200° C., the SCR unit 174 may be at approximately 150° C. As noted, to reduce the time of heating the SCR unit 174, the heater 186 may be used. However, in embodiments without the heater 186, and in those with the heater 186, the system may not be capable of raising the SCR unit 174 temperature fast enough, even if all of the units are close-coupled. When the SCR unit 174 is underfloor, an even larger range gap where the release threshold temperature is reached but the conversion threshold temperature is not, may occur. In embodiments where a rapid warmup cycle is used, such as in operation of the engine 110, the PNA unit 172 may reach the release threshold temperature faster. Separating the DOC unit 170 and the PNA unit 172 sequentially in the exhaust gas stream 112 with the DOC unit 170 closer to the engine 110 means that the DOC unit 170 heats faster than the PNA unit 172 when the engine 110 is started. Heating the DOC unit 170 quickly is desirable so that it quickly reaches its conversion threshold temperature without HC leakage.

In embodiments, the controller 142 may operate to effect a rapid warmup cycle such as by means of controlling the operational set points of the engine 110. The engine 110 is subjected to warmup control, as prompted by the controller 142, to operate in an accelerated warmup mode/state. For example, signals from the controller 142 may prompt a change of the air/fuel ratio of the operating engine 110 to raise the heat generated during combustion. In another example valve timing may be adjusted such as with early exhaust valve opening. In another example, EGR rates may be adjusted. In another example, intake air may be restricted. In another example, the fuel system may be operated to deliver split injections of fuel through the injectors. With split injections, rather than using a single injection profile for an injector, two or more injection pulses are delivered with a delay dwell between the pulses. In other examples, loads may be increased on the engine 110, such as through the set points of the transmission or by other means. These controls result in more heat being delivered to the exhaust system 114 for aftertreatment heating purposes.

In certain circumstances, a delay in the heating of the PNA unit 172 has been found as part of the current disclosure to be beneficial. As shown in FIG. 2, the PNA unit 172 is downstream from the DOC unit 170. The downstream location slows the heating of the PNA unit 172 due to heat absorption and shielding provided by the DOC unit 170, which takes up the available heat first, and by means of other heat losses as the exhaust gas stream 112 moves downstream. During this time period the heater 186, when included, may be activated by the controller 142 to warm the SCR unit 174 faster. The sensor array 150 may provide inputs to the controller 142 including on the various temperatures in the exhaust pipe assembly 130. Threshold range gap or threshold gap would mean the PNA unit 172 reaches its release threshold temperature before the SCR unit 174 reaches its conversion threshold temperature. The result from the system architecture and control of this disclosure is to ensure that the SCR unit 174 reaches the conversion threshold temperature before the PNA unit 172 reaches the release threshold temperature. Commercially available modeling software and/or testing may be used to determine the optimal placement of the PNA unit 172 in the exhaust system 114 to avoid a threshold gap. Such determination factors in the materials used in the various units, the system and component design, and the engine/application details.

In embodiments, during a cold start rapid warmup cycle the controller 142, via the processor 144, may determine that the warmup cycle should be modified and may control the engine 110 to generate heat faster or slower as needed. For example, if the PNA unit 172 is heating too quickly, the set points of the engine 110 may be modified to reduce the heat generated by the engine 110. In other actions, the controller 142, via the processor 144, may determine that the heater 186 be supplied with more power to increase heating of the SCR unit 174 and may initiate the control action to supply more power. The controller 142, via monitoring temperatures using the sensor array 150, may operate the metering valve 184 to deliver reductant to the SCR unit 174 in advance of, or when, NOx release from PNA unit 172 begins.

In addition to the arrangement of FIG. 2, additional aftertreatment arrangements are contemplated within the system architecture that includes a PNA catalyst with NOx storage function downstream from the DOC, and different electrical heating options, such as no heating, heating during warmup and heating after warmup to increase conversion effectiveness. The various components may be arranged in different combinations and sequences depending on factors such as emission targets and application details.

Figure 3:
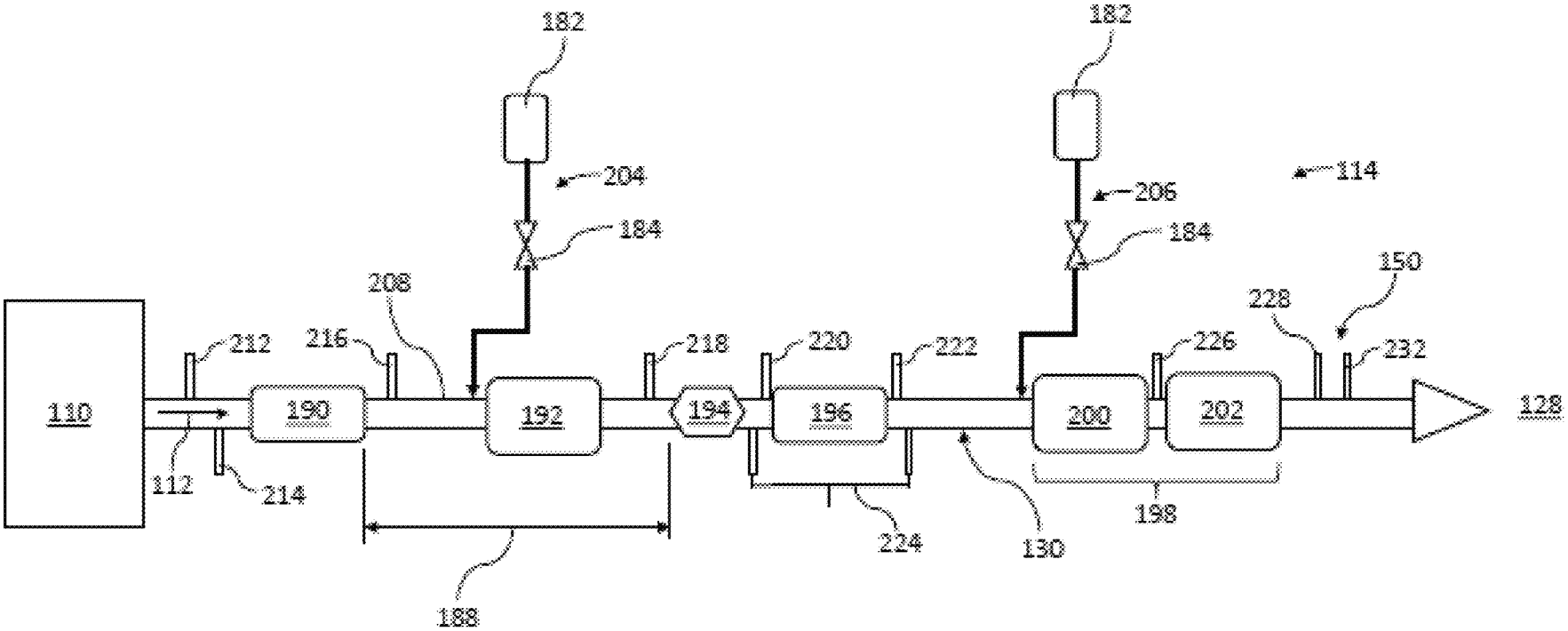
FIG. 3 is a schematic illustration of the aftertreatment system of FIG. 1 with a PNA and no in-line electric heater, in accordance with various embodiments.

Referring to FIG. 3, aspects of the exhaust system 114 are illustrated for an embodiment of the above described architecture. The exhaust pipe assembly 130 conveys the exhaust gas stream 112 from the engine 110 to atmosphere 128. The exhaust pipe assembly 130 is arranged so that the exhaust gas stream 112 first passes through a DOC unit 190 and then through an SCR unit 192. A PNA unit 194 is disposed downstream from the SCR unit 192. A DPF unit 196 is disposed downstream from the PNA unit 194. The DPF unit 196 may be a catalyzed diesel particulate filters (cDPF) that in addition to filtering incudes a catalyst on the filter and operates to reduce PM, and to oxidize HC, CO and NO to support a downstream SCR. In that regard, downstream from the DPF unit 196 is an SCR unit 198. The SCR unit 198 may be a dual stage unit where the stages are tailored to provide specific functions. For example, the first stage 200 may be tailored to convert NOx, which may be enhanced by an upstream injection of DEF. The second stage 202 may be tailored to convert NOx and/or may include an ammonia oxidation catalyst (AOC) to oxidize and ammonia.

As illustrated, the exhaust pipe assembly 130 includes a reductant dosing system 204 upstream from the SCR unit 192 and a reductant dosing system 206 upstream from the SCR unit 198. The reductant dosing systems 204 and 206 are operated by the controller 142. After leaving the engine 110, the exhaust gas stream passes through, in order, the DOC unit 190, the SCR unit 192, the PNA unit 194, the DPF unit 196, the SCR unit 198 and is exhausted to atmosphere 128. A pipe section 208 channels the exhaust gas stream 112 between, and separates, the DOC unit 190 and the PNA unit 194 by a distance 188 selected to allow the PNA unit 194 to warm at a selected rate. In this embodiment, the SCR unit 192 is in the pipe section 208. In other embodiments, the SCR unit 192 may not be in the pipe section 208, which may be direct from the DOC unit 190 to the PNA unit 194.

Location of the PNA unit 194 in the exhaust pipe assembly 130 downstream of both the DOC unit 190 and the SCR unit 192 means that both of those units heat more quickly than the PNA unit 194 following a cold start of the engine 110. Heat in the exhaust gas stream 112 is reduced by heating the section of the exhaust pipe assembly upstream from the PNA unit 194 including the DOC unit 190 and the SCR unit 192. In addition, heat transfer/loss is incurred through other parts of that upstream pipe assembly section. The amount of time that elapses to heat the PNA unit 194 to the release threshold temperature is longer as compared to if the PNA unit 194 is disposed further upstream.

The exhaust pipe assembly 130 also includes a number of sensors of the sensor array 150. For example, between the engine 110 and the DOC unit 190 a NOx sensor 212 provides a signal to the controller 142 representative of the NOx level exiting the engine 110. Temperature sensors 214 and 216 are disposed on each side (upstream and downstream) of the DOC unit 190 providing signals to the controller 142 on DOC in temperature and DOC out temperature respectively, of the exhaust gas stream 112. A NOx sensor 218 is disposed downstream from the SCR unit 192 and upstream from the PNA unit 194 that provides a signal to the controller 142 representative of the NOx level exiting the SCR unit 192. Temperature sensors 220 and 222 are disposed on each side (upstream and downstream) of the DPF unit 196 providing signals to the controller 142 representative of DPF in temperature and DPF out temperature respectively, of the exhaust gas stream 112. A differential pressure sensor (DPS) 224 is disposed on each side (upstream and downstream) of the DPF unit 196 providing signals to the controller 142 representative of the pressure change of the exhaust gas stream 112 through the DPF unit 196. The DPS sensor 224 may be configured as a digital remote sensor (DRS) transmitter that compares pressure on the upstream side with pressure on the downstream pressure side with a DRS communication mechanism. A temperature sensor 226 is disposed between the first stage 200 and the second stage 202 of the SCR unit 198. A NOx sensor 228 is disposed downstream from the SCR unit 198 to monitor for NOx leaving the exhaust pipe assembly 130. A PM sensor 232 is also disposed downstream from the SCR unit 198 to monitor for PM leaving the exhaust pipe assembly 130.

Figure 4:
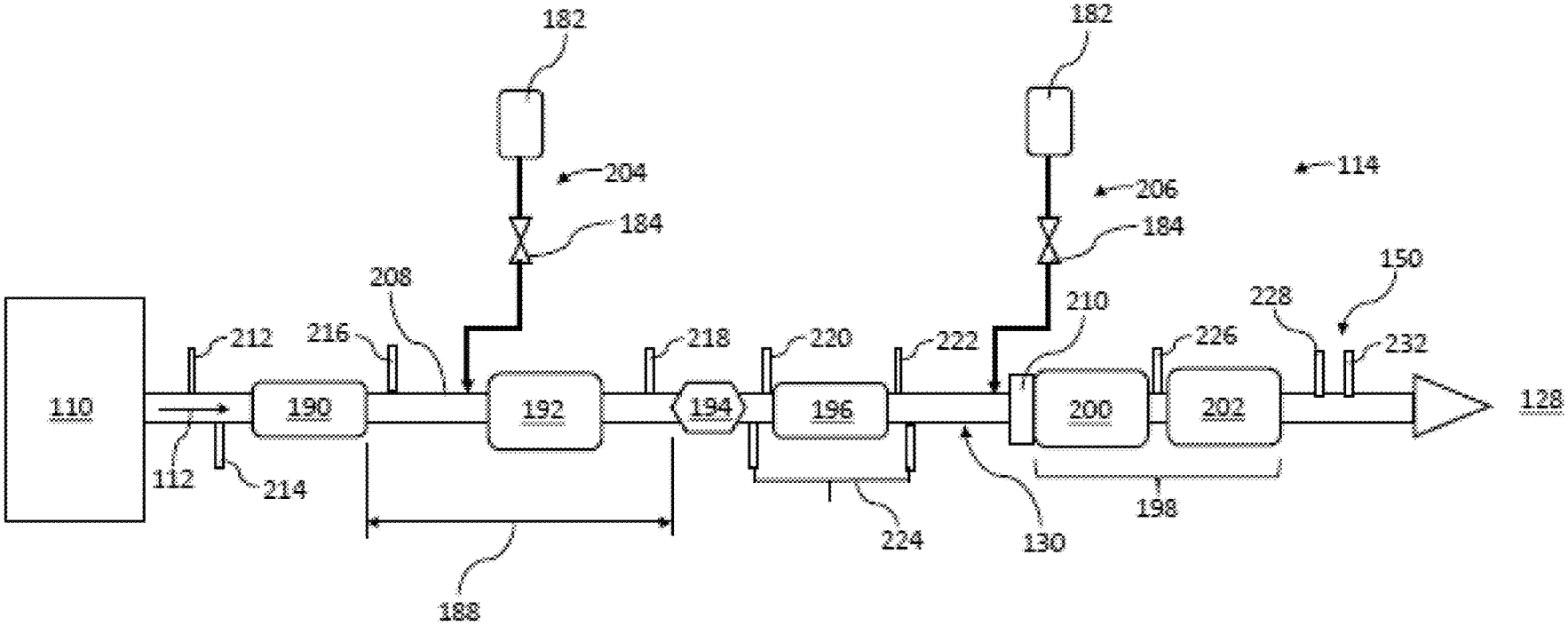
FIG. 4 is a schematic illustration of the aftertreatment system of FIG. 1 with a PNA and an in-line electric heater upstream from an underfloor SCR, in accordance with various embodiments.

Referring to FIG. 4, the exhaust pipe assembly 130 also includes a heater 210 disposed to heat the exhaust gas stream 112 before it enters the SCR unit 198. The heater 210 may be an electric heated catalyst (EHC) heater that is operated by the controller 142 and may use the vehicle's electric system voltage e.g., 12V, 24V, 48V, etc. The heater 210 may be operated to decrease the amount of time that elapses in raising the SCR temperature to the conversion threshold temperature. In some embodiments, the heater 210 may be used to increase conversion efficiency even after the SCR has reached the conversion threshold temperature, leading to an overall increase in system NOx reduction due to the increased catalytic activity in the SCR.

In an example, when the engine 110 is started after a period of off time so that it is at a cold state, the controller 142 initiates actions to warm the exhaust system 114. The controller 142 receives signals from the sensor array 150 and, when the signals from the temperature sensors 214 and/or 216 indicate the DOC unit 190 is below the conversion threshold temperature, the controller 142 initiates operation of the engine 110 in a rapid warmup mode. The controller 142 moves the set points of the engine 110 to generate more heat than would otherwise result from operation of the engine 110 at the current torque demands. In the system of FIG. 4, when the signal from the temperature sensor 226 indicates that the SCR unit 198 is below the conversion threshold temperature, the controller 142 initiates operation of the heater 210.

Using input from the sensor array 150, the controller 142 determines the conversion effectiveness of the DOC unit 190, the SCR unit 192, the PNA unit 194 and the SCR unit 198 based on concentration levels of certain constituents, and determines the temperatures in the exhaust pipe assembly 130. The controller 142 may make adjustments in the operation of the engine 110 and the heater 210 (when included), to change their heating rates. Through inputs from the temperature sensor 220, which is downstream from the PNA unit 194, the controller determines whether the PNA unit 194 is approaching the release threshold temperature. If the PNA unit 194 is approaching the release threshold temperature faster than the SCR unit 198 is approaching the conversion threshold temperature, the controller 142 may decrease heat generation by the engine 110 and/or may increase the heat generated by the heater 210, when included.

When the SCR unit 198 reaches the conversion threshold temperature, the controller 142 operates the reductant dosing system 206 and injects urea into the exhaust system upstream from the SCR unit 198. When the SCR unit temperature has surpassed the conversion threshold temperature by a calibrated $\Delta T$, the controller 142 turns the heater 210 off, when included. It should be understood that the exhaust pipe assembly 130 may have additional components such as sensors, mixers, valves, etc., which are not shown.

Figure 5:
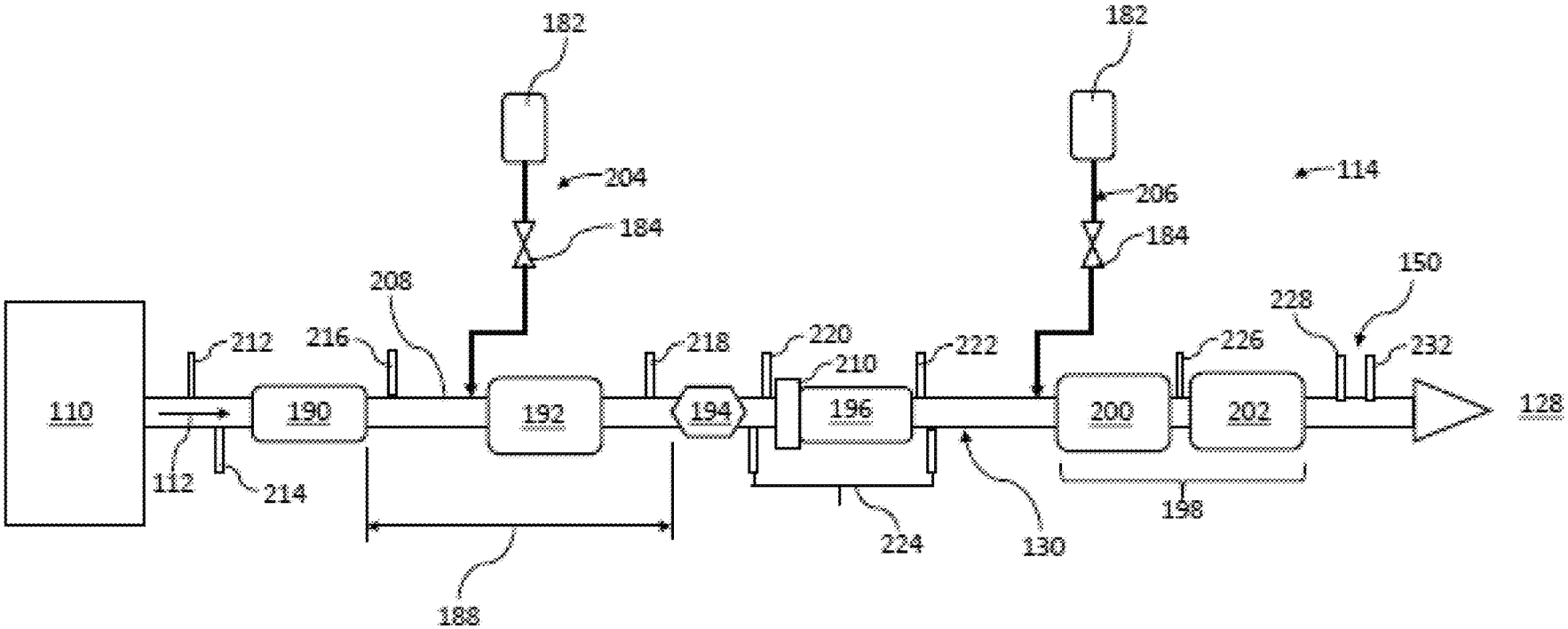
FIG. 5 is a is a schematic illustration of the aftertreatment system of FIG. 1 with a PNA and an in-line electric heater upstream from a close-coupled SCR, in accordance with various embodiments.

Referring to FIG. 5, the exhaust pipe assembly 130 is similar to that of FIG. 4, with the heater 210 moved to a point directly upstream from, or in, the DPF unit 196. The heater 210 may be activated by the controller 142 to heat the SCR unit 198, which is downstream from the DPF unit 196. The heater 210 may be activated by the controller 142 to provide electrically assisted DPF regeneration cycles. Electric assist may be provided to clean the DPF unit 196 at lower exhaust temperatures then would be available without the heater 210. In addition, electric assist may be provided to heat to a soot oxidation temperature to trigger regeneration without consuming additional fuel such as would be the case when fuel is provided to the exhaust system 114 which is oxidized over the DOC to heat the DPF to regeneration temperature.

Figure 6:
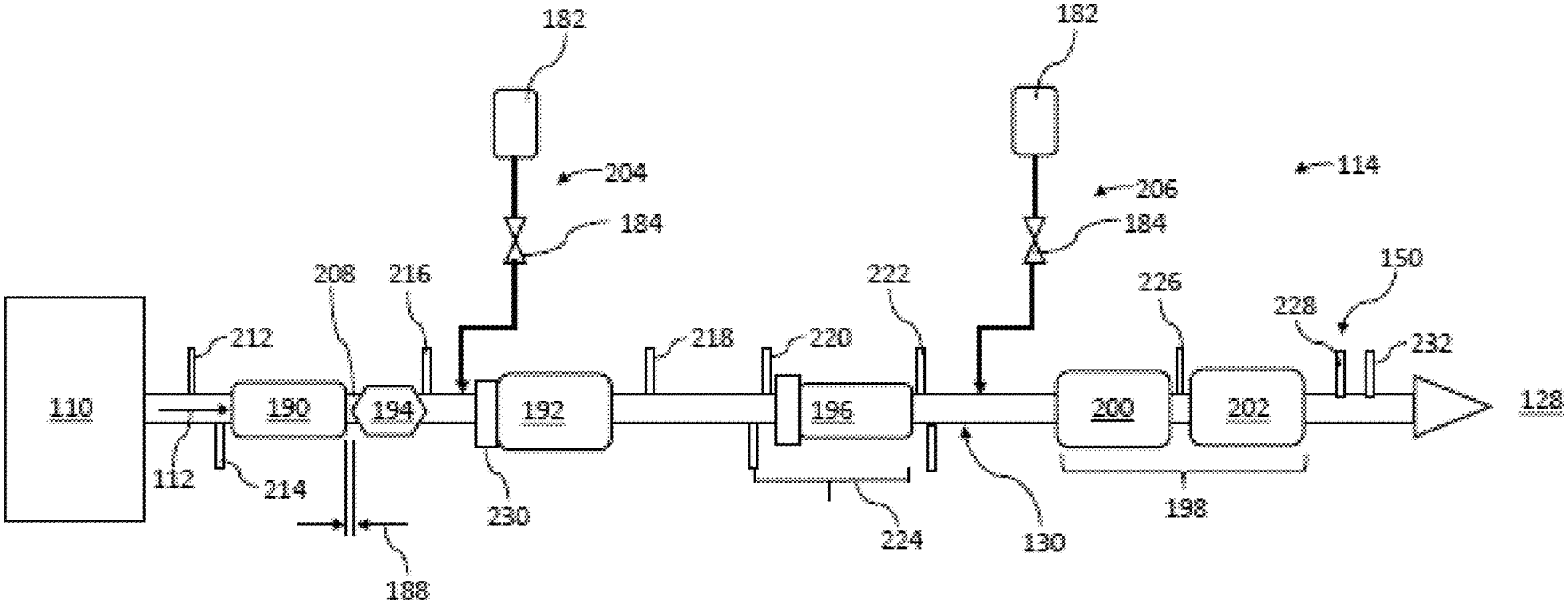
FIG. 6 is a is a schematic illustration of the aftertreatment system of FIG. 1 with a PNA downstream from a DOC and an in-line electric heater, in accordance with various embodiments.

Referring to FIG. 6, the exhaust pipe assembly 130 is similar to that of FIG. 5, with the PNA unit 194 moved to a point between the DOC unit 190 and the SCR unit 192 at the distance 188 from the DOC unit 190 defined by the pipe section 208. A second heater 230 is added at a point upstream from the SCR unit 192 and downstream from the PNA unit 194. The close coupled part of this arrangement is similar to that of FIG. 2. The exhaust gas stream 112 passes through, in order, the DOC unit 190, the PNA unit 194 and the SCR unit 192. The PNA unit 194 is located downstream and separate from the DOC unit 190 to heat up slower. The heater 230 is located downstream from the PNA unit 194 and upstream from the SCR unit 192 to heat the SCR unit 192 but not the PNA unit 194.

An exhaust system's aftertreatment architecture and control system as disclosed herein includes a number of elements that ensure the DOC and/or the SCR warms quickly to an effective temperature while the PNA warms more slowly to provide an optimal NOx storage function. These results are provided, including during a cold phase of the exhaust system's operation. Without the benefits of the current disclosure, during cold phase operation DOC HC conversion may not be optimized during the PNA NOx collection phase. Also, without the benefits of the current disclosure, SCR NOx conversion may not be optimized when the PNA transitions to NOx release at and above a release threshold temperature. Through the embodiments disclosed herein, the DOC rapidly reaches effective HC conversion and the PNA does not release its stored NOx until the SCR is prepared to convert it. The PNA does not self-purge until the SCR has reached its light-off temperature (conversion threshold temperature).

Accordingly, an exhaust system architecture optimizes NOx conversion for certain purposes by controlling DOC, PNA and SCR heating rates in a coordinated and targeted fashion. The PNA is located downstream from the DOC, and the two may be structured in a common or in separate containers. The architecture is compatible with rapid warmup routines and electric heating options when desired. The various emission control components may be arranged according to the particular application's requirements and emission targets. HC and NOx emissions are controlled according to targets during cold starts and during the entire driving cycle including high load conditions. During a cold start, the PNA stores NOx without reaching its release threshold temperature before the downstream SCR is at its conversion threshold temperature and is ready for urea injection.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. An aftertreatment system for an engine comprising:

a conduit system configured to convey an exhaust gas stream generated by the engine from the engine to atmosphere;

a diesel oxidation catalyst (DOC) unit in the conduit system;

a selective catalyst reduction (SCR) unit in the conduit system downstream from the DOC unit;

a passive nitrogen oxide absorber (PNA) unit in the conduit system located downstream from the DOC unit at a location that is disposed at a distance from the engine; and at least one controller configured to:

monitor, through signals from a sensor array, parameters of the aftertreatment system;

determine, by at least one processor, whether the PNA unit is approaching the release threshold temperature; and control, by the at least one processor, the engine to adjust heat output from the engine, wherein the distance is configured to, following a cold start of the engine, enable the SCR unit to heat to a conversion threshold temperature before the PNA unit heats to a release threshold temperature.

2. The aftertreatment system of claim 1, wherein the PNA unit is located in the conduit system upstream in the exhaust gas stream from the SCR unit.

3. The aftertreatment system of claim 1, comprising a heater in the conduit system disposed upstream in the exhaust gas stream from the SCR unit.

4. The aftertreatment system of claim 1, wherein the DOC unit and the PNA unit are disposed in one container with the PNA unit separate from the DOC unit.

5. The aftertreatment system of claim 1, wherein the PNA unit is located in the conduit system upstream in the exhaust gas stream from the SCR unit, and comprising a second SCR unit located upstream in the exhaust gas stream from the PNA unit.

6. The aftertreatment system of claim 1, wherein the engine is disposed in an engine compartment of a vehicle, wherein the DOC unit, the PNA unit and the SCR unit are all disposed in the engine compartment.

7. The aftertreatment system of claim 1, wherein the conduit system includes a pipe section channeling the exhaust gas stream and separating the DOC unit from the PNA unit by the distance.

8. The aftertreatment system of claim 1, wherein the at least one controller is further configured, via monitoring temperatures of the exhaust gas stream using a sensor array, to operate a metering valve to deliver a reductant to the SCR unit in advance of, or when, a nitrogen oxide (NOx) release from the PNA unit begins.

9. The aftertreatment system of claim 1, wherein the at least one controller is further configured to:

determine, by the at least one processor and based on the signals whether the SCR unit is approaching the conversion threshold temperature.

10. The aftertreatment system of claim 1, wherein the at least one controller is further configured to:

determine, by the at least one processor and based on the signals, whether the SCR unit is approaching the conversion threshold temperature; and control, by the at least one processor, a heater so that the SCR unit reaches the conversion threshold temperature before the PNA unit reaches the release threshold temperature.

11. An aftertreatment system for an engine comprising:

a conduit system configured to convey an exhaust gas stream generated by the engine from the engine to atmosphere;

a diesel oxidation catalyst (DOC) unit in the conduit system configured to convert hydrocarbons (HC);

a selective catalyst reduction (SCR) unit in the conduit system downstream in the exhaust gas stream from the DOC unit and configured to convert nitrogen oxides (NOx);

a passive NOx absorber (PNA) unit in the conduit system configured to store NOx and located downstream in the exhaust gas stream from the DOC unit at a location that is disposed at a distance from the engine; and at least one controller configured to:

monitor, through signals from a sensor array, parameters of the aftertreatment system, wherein the sensor array includes temperature sensors in the conduit system;

determine, by at least one processor, whether the PNA unit is approaching the release threshold temperature at which the PNA unit releases NOx; and control, by the at least one processor, the engine to adjust heat output from the engine to slow the heating of the PNA unit, wherein the distance is configured to, following a cold start of the engine, enable the SCR unit to heat to a conversion threshold temperature before the PNA unit heats to a release threshold temperature.

12. The aftertreatment system of claim 11, wherein the PNA unit is located in the conduit system upstream in the exhaust gas stream from the SCR unit so that when the PNA unit reaches the release threshold temperature, a release of the NOx into the exhaust gas stream is directed through the SCR unit.

13. The aftertreatment system of claim 11, comprising a heater in the conduit system disposed upstream in the exhaust gas stream from the SCR unit and located downstream in the exhaust gas stream from the PNA unit.

14. The aftertreatment system of claim 11, wherein the DOC unit and the PNA unit are disposed in one container with the PNA unit configured in a first space that is separate from a second space containing the DOC unit, wherein the PNA unit and the DOC unit are defined on a common substrate.

15. The aftertreatment system of claim 11, wherein the PNA unit is located in the conduit system upstream in the exhaust gas stream from the SCR unit, and comprising a second SCR unit located upstream in the exhaust gas stream from the PNA unit, and comprising a heater located downstream in the exhaust gas stream from the PNA unit.

16. The aftertreatment system of claim 11, wherein the engine is disposed in an engine compartment of a vehicle, wherein the DOC unit, the PNA unit and the SCR unit are all disposed in the engine compartment, and comprising a floor pan of the vehicle, wherein a second SCR unit is located under the floor pan and outside the engine compartment.

17. The aftertreatment system of claim 11, wherein the conduit system includes a pipe section channeling the exhaust gas stream and separating the DOC unit from the PNA unit by the distance, wherein the distance is configured to reduce a temperature of the exhaust gas stream between the DOC unit and the PNA unit by a target magnitude.

18. The aftertreatment system of claim 11, comprising a heater in the conduit system, wherein the at least one controller is further configured to:

determine, using input from a sensor array, conversion effectiveness of the DOC unit, the SCR unit and the PNA unit based on concentration levels in the exhaust gas stream;

determine whether the PNA unit is approaching a release threshold temperature; and when the PNA unit is approaching the release threshold temperature faster than the SCR unit is approaching a conversion threshold temperature, the controller decreases engine heat generation and/or increases heater heat generation.

19. The aftertreatment system of claim 11, wherein the at least one controller is further configured to:

determine, by the at least one processor and based on the signals, whether the SCR unit is approaching the conversion threshold temperature at which the SCR unit converts NOx at a threshold rate; and control, by the at least one processor, the engine to adjust heat output from the engine so that the SCR unit reaches the conversion threshold temperature before the PNA unit reaches the release threshold temperature.

20. An aftertreatment system for an engine comprising:

a conduit system configured to convey an exhaust gas stream generated by the engine from an exhaust manifold of the engine to atmosphere;

a diesel oxidation catalyst (DOC) unit in the conduit system configured to convert hydrocarbons (HC);

a selective catalyst reduction (SCR) unit in the conduit system downstream in the exhaust gas stream from the DOC unit and configured to convert nitrogen oxides (NOx);

a passive NOx absorber (PNA) unit in the conduit system configured to store NOx in a first temperature range and configured to release the NOx in a second temperature range, the PNA unit located downstream in the exhaust gas stream from the DOC unit at a location that is disposed at a distance from the exhaust manifold of engine, wherein the distance is configured to, following a cold start of the engine, enable the SCR unit to heat to a conversion threshold temperature before the PNA unit heats to a release threshold temperature;

an electric heater in the conduit system disposed upstream in the exhaust gas stream from the SCR unit and located downstream in the exhaust gas stream from the PNA unit; and at least one controller configured to:

monitor, through signals from a sensor array, parameters, including temperatures, of the aftertreatment system;

determine, by at least one processor and based on the signals, whether the PNA unit is approaching the release threshold temperature;

determine, by the at least one processor and based on the signals, whether the SCR unit is approaching the conversion threshold temperature; and control, by the at least one processor, the engine to adjust heat output from the engine and the electric heater so that the SCR unit reaches the conversion threshold temperature before the PNA unit reaches the release threshold temperature.

* * * * *